United States Patent [19]

Potapov et al.

[11] Patent Number: 4,660,400

[45] Date of Patent: Apr. 28, 1987

[54] PILGER MILL STAND

[75] Inventors: Ivan N. Potapov, Moscow; German D. Styrkin, Noginsk, Moskovskaya; Ivan P. Gremyakov; Alexei D. Sheikh-Ali, both of Moscow, all of U.S.S.R.

[73] Assignee: Moskovsky Institut Stali I Splavov, Moscow, U.S.S.R.

[21] Appl. No.: 769,986

[22] PCT Filed: Dec. 21, 1983

[86] PCT No.: PCT/SU83/00050

§ 371 Date: Jul. 15, 1985

§ 102(e) Date: Jul. 15, 1985

[87] PCT Pub. No.: WO85/02795

PCT Pub. Date: Jul. 4, 1985

[51] Int. Cl.[4] ..... B21B 21/00; B21B 31/04; B21B 31/14; B21B 31/26

[52] U.S. Cl. ..... 72/214; 72/237; 72/238; 72/243; 72/244

[58] Field of Search ..... 72/214, 243, 242, 241, 72/237, 248, 238, 244

[56] References Cited

U.S. PATENT DOCUMENTS

| | | | |
|---|---|---|---|
| 3,307,386 | 3/1967 | Ward et al. | 72/241 |
| 3,431,762 | 3/1969 | O'Brien | 72/243 |
| 4,237,714 | 12/1980 | Polukhin et al. | 72/242 |

FOREIGN PATENT DOCUMENTS

| | | |
|---|---|---|
| 1287541 | 1/1969 | Fed. Rep. of Germany . |
| 365090 | 12/1977 | U.S.S.R. . |
| 806176 | 2/1981 | U.S.S.R. . |

*Primary Examiner*—Robert L. Spruill
*Assistant Examiner*—Steve Katz
*Attorney, Agent, or Firm*—Lilling & Greenspan

[57] ABSTRACT

The disclosed stand comprises a housing with carriers that are located pairwise on either side of the axis of rolling oppositely to each other and accommodate the bearing chocks of the work rolls. The work rolls are disposed one above the other between the backup rolls. A device for prestressing the stand is included. A device for prestressing the work rolls separately interconnects the bearing chocks of the work rolls of each pair located one above the other.

2 Claims, 4 Drawing Figures

PILGER MILL STAND

FIELD OF THE INVENTION

The present invention relates to the manufacture of tubes and has specific reference to pilger mill stands which are essential parts of a mill.

BACKGROUND OF THE INVENTION

The rolling of thin-walled tubes from metals and alloys that are reluctant to yield to deformation poses now the problem of increasing the robustness of stands, increasing the accuracy of roll setting, and preloading the rolls in the radial direction.

DESCRIPTION OF THE PRIOR ART

There is known a cold pilger mill stand (cf. Federal Republic of Germany Pat. No. 1,287,541; B21B 31/04; 1967) incorporating a housing with carriers which are located pairwise on either side of the rolling axis oppositely to each other. A cap is attached to the carriers, and bearing chocks are fitted into vertical guides of the carriers to give support to the work rolls located one above the other.

The stand is provided with a means of preloading the work rolls, which consists of coupling screws designed to link the bearing chokes vertically pairwise. This arrangement provides for an accurate dimensioning of the tubes during rolling. At the same time, all the rolling pressure is sustained by the bearing chocks of work rolls only, for the stand is not provided with backup rolls. Therefore, the strength of the chocks limits the amount of deformation of the tube blank in operation. Apart from that, the mill must be stopped for preloading the rolls so that the operating availability of the mill is consequently reduced.

The known stand lacks a means of monitoring the preloading. This feature invites difficulties in maintaining dimensional stability of the tubes rolled.

Also known is a pilger mill stand (cf. Polulchin, U.S. Pat. No. 4,237,714) which is adopted as the prototype of the invention. This stand incorporates a housing with carriers which are located pairwise on either side of the rolling axis oppositely to each other. A cap and a means of preloading the stand are pivotally attached to the carriers.

The stand is provided with an upper backup roll and a lower one supported by chocks. Work rolls, one overlaying the other, are arranged between the backup rolls and supported by relevant chocks which fit into vertical guides of the carriers. For preloading the stand, the backup rolls can be moved vertically integrally with their bearing chocks towards the work rolls.

The prototype mill stand is simple and reliable. It can turn out accurately dimensioned tubes from any material, even one which deforms reluctantly. Robustness of the stand and of the means of preloading the rolls is a factor providing for good performance. By pressing the work rolls against each other with the aid of the backup rolls, the work rolls/backup rolls/housing system is prestressed rapidly and uniformly. The amount of prestressing can be varied over a wide range without stopping the mill. Pressure transducers permit a constant monitoring of the prestressed state.

However, since the work rolls are preloaded by means of the backup rolls directly, high compressive stresses are set up in the work rolls at the place of their contact with the backup rolls at the instant when the work rolls begin to deform the tube blank. These stresses coming into play in the areas of contact between the work rolls and the backup rolls bring about rapid local wear of the rolls. Flaking and local crumbling-out of rolls are also likely to occur when the stresses become critically high. Particularly prone to damage are the work rolls, for the maximum load they sustain is invariably confined to the same localities on the rolls.

Since the total load due to the rolling pressure and the prestressing action is carried by the bearing chocks of backup rolls only, these chocks wear down rapidly. This not only shortens the service life of the bearing chocks of backup rolls but also impairs the reliability of the stand.

SUMMARY OF THE INVENTION

The main object of the invention is to provide a pilger mill stand wherein the means of prestressing the stand and the work rolls are designed so as to reduce the load on the bearing chocks of the backup rolls and enhance thereby the reliability of the stand.

This object is realized by a pilger mill stand which comprises a housing with carriers that are located pairwise on either side of the axis of rolling oppositely to each other and are provided with vertical guides into which bearing chocks of the work rolls are fitted. The work rolls are disposed one above the other between an upper backup roll and a lower backup roll supported in relevant bearing chocks. A cap and a means of prestressing the stand are both pivotally linked to the carriers. There is also provided, according to the invention, an additional means of prestressing the work rolls which separately interconnects the bearing chocks of the work rolls of each pair located one above the other.

The additional means of prestressing the work rolls changes the pattern of loading of the bearing chocks of the work rolls and those of the backup rolls depending on the load-bearing capacity of the chocks. A small fraction of the load due to the prestressing action and the rolling pressure comes on the bearing chocks of the work rolls and the bulk of the load is carried by the bearing chocks of the back-up rolls. The changed loading pattern extends the service life of the bearing chocks of the backup rolls and enhances the reliability of the stand.

It is expedient that the additional means of prestressing be provided in the form of two leverages with eccentric elements. Each of these arrangements consists of two vertical tie rods which pivotally link the opposite sides of the bearing chocks of the work rolls. One of the bearing chocks is connected to each tie rod by a fulcrum pin and the other bearing chock is connected to one tie rod through a pressure transducer and to the other tie rod by way of an eccentric shaft turnable by a drive.

The means of prestressing of the above design permits a uniform prestressing of the work rolls by bringing their bearing chocks closer to each other in operation. The load thus applied to the bearing chocks of the work rolls can be constantly monitored with the aid of the pressure transducers.

BRIEF DESCRIPTION OF THE DRAWINGS

A preferred embodiment of the present invention will now be described by way of an example of a double-strand mill stand with reference to the accompanying drawings in which.

DETAILED DESCRIPTION OF THE INVENTION

Figure 2:
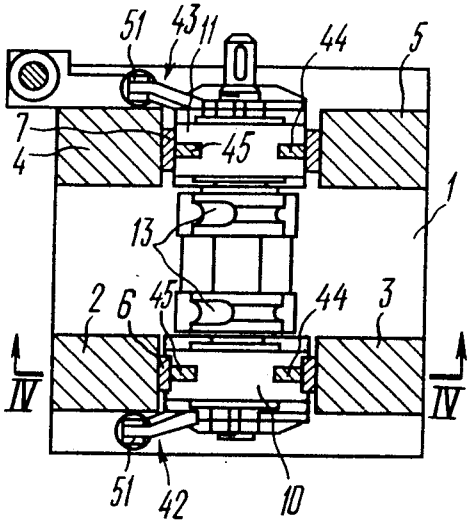
FIG. 2 is a cross-sectional view taken along line II—II of FIG. 1.
Figure 1:
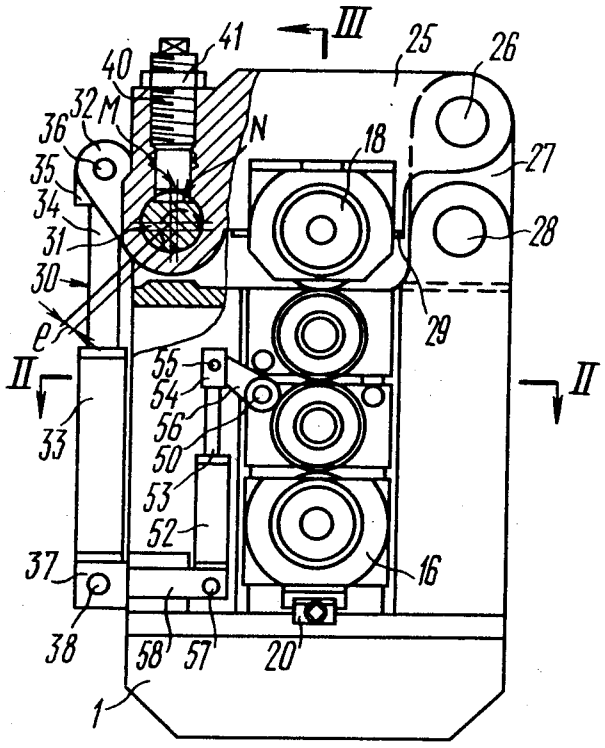
FIG. 1 is a side elevational view of the stand as seen from the side convenient for servicing.
Figure 3:
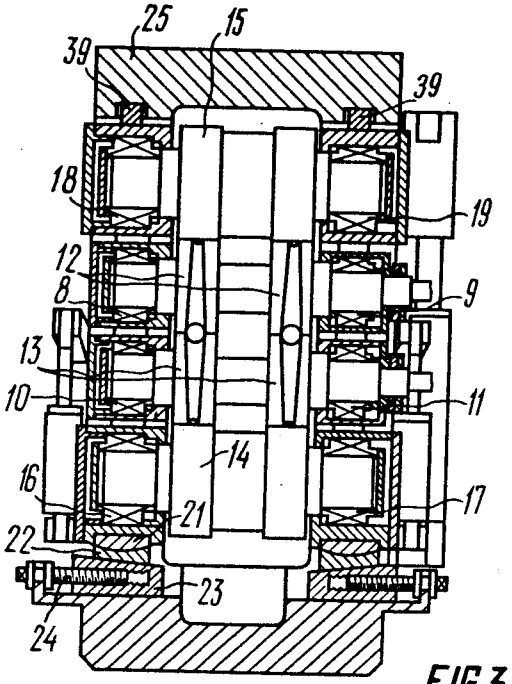
FIG. 3 is a cross-sectional view taken along line III—III of FIG. 1.

Referring to FIGS. 1 and 2, the pilger mill stand, according to the invention, comprises a housing 1 and carriers 2,3 and 4,5 which are located pairwise on either side of the axis of rolling oppositely to each other. The carriers 2,3,4,5 are provided with vertical guides 6,7 into which bearing chocks 8,9,10,11 of the work rolls 12,13 (FIGS. 2,3) are fitted. The work roll 12 is supported in the bearing chocks 8,9 and the work roll 13 is supported in the bearing chocks 10,11. The bearing chocks 8,10, which are located at the side of the stand convenient for servicing and give support to the work rolls 12,13, are provided with vertical rectangular grooves into which the vertical guides 6 of the carriers 2,3 (FIG. 2) are fitted. The work roll 12 overlays the work roll 13, and both of them are interposed between a lower backup roll 14 and an upper backup roll 15 which are supported by bearing chocks 16,17 and 18,19, respectively (FIGS. 1,3). The bearing chock 16, which gives support to the lower backup roll 14 at the servicing side, is provided in its side, by analogy with the bearing chocks 8,10 of the work rolls 12,13, with vertical rectangular grooves into which the vertical guides 6 of the carriers 2,3 are fitted. The bearing chocks 8,9,10,11 of the work rolls 12,13 and the bearing chocks 16,17 of the lower backup roll 14 can be moved up and down for adjustment along the vertical guides 6, 7 of the housing 1.

Figure 4:
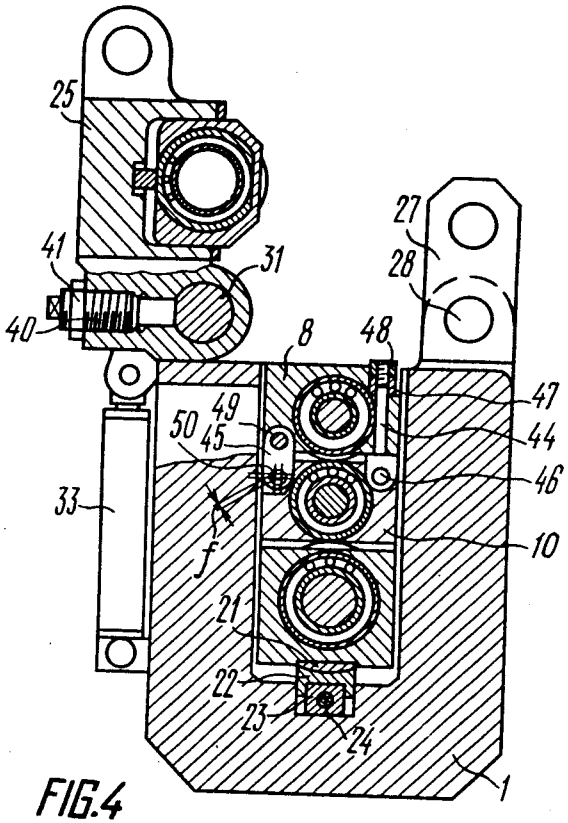
FIG. 4 is a cross-sectional view taken along line IV—IV of FIG. 2.

The work rolls 12,13 can be adjusted for vertical position with the aid of the lower backup roll 14. To that end, each of the bearing chocks 16,17 of the roll 14 is provided with a means of vertical setting. In the preferred embodiment of the invention, the means of vertical setting are wedge mechanism 20 (FIGS. 1,3,4) located between the carriers 2,3 and the carriers 4,5 of the housing 1. Each wedging mechanism 20 consists of a spherical toe 21 and a thrust bearing 22 which rests on a movable wedge 23 set into motion by a screw 24.

The stand has a cap 25 which is pivotally attached to the carriers 3 and 5 through a fulcrum pin 26, a link 27 and a fulcrum pin 28. Fitted into the cap 25 are the bearing chocks 18,19 of the upper backup roll 15. Lock bars 29 are used to hold fast the bearing chocks 18 and 19.

The stand is provided with a means 30 of prestressing consisting of an eccentric shaft 31 with a throw "e" (FIG. 1) which pivotally links the cap 25 to the carriers 2,4 of the housing 1, a lever 32 secured to an end of the eccentric shaft 31, and a power cylinder 33. The piston rod 34 of the power cylinder 33 is pivotally linked to the lever 32 through a shackle 35 and a fulcrum pin 36. The power cylinder 33 is attached to the carrier 4 of the housing 1 with the aid of a bracket 37 and a fulcrum pin 38.

Pressure transducers 39 which monitor the load on the bearing chocks 18,19 of the upper backup roll 15 (FIG. 3) are accommodated in the cap 25. A threaded stop 40 with a lock nut 41 (FIGS. 1,4) is provided in the cap 25 to prevent the eccentric shaft 31 against rotation, the end face "M" of the threaded stop 40 can abut against a flat "N" on the eccentric shaft 31.

The stand is also provided with an additional means of prestressing the work rolls 12,13 (FIGS. 2,4) in the form of two leverages 42,43 with eccentric elements of identical layout. The leverage 42 incorporates two vertical tie rods 44,45 which pivotally link the opposite sides of the bearing chocks 8,10 of the work rolls 12,13. The tie rod 44 is pivotally coupled to the bearing chock 10 of the work roll 13 (FIG. 4) through a fulcrum pin 46 and to the bearing chock 8 by way of a pressure transducer 47 and a back nut 48. The tie rod 45 is pivotally connected to the bearing chock 8 via a fulcrum pin 49 and to the bearing chock 10 through an eccentric shaft 50 which has a throw "f" and is rotated by a drive 51 (FIG. 2). The drive 51 consists of a power cylinder 52 (FIG. 1) which is pivotally attached to the carrier 2 of the housing 1 by means of a fulcrum pin 57 and a bracket 58. The piston rod 53 of the power cylinder 52 is pivotally linked to a lever 56 through a shackle 54 and a fulcrum pin 55. The lever 56 is firmly attached to an end of the eccentric shaft 50.

The additional means of prestressing the work rolls can be provided in any other known form differing from that described hereinabove. However, the described construction consisting of two leverages 42,43 with eccentric elements is simple and reliable. It prestresses only the work rolls 12,13 by bringing their respective bearing chocks 8,10 and 9,11 closer to each other in operation. This changes the pattern of the loading due to the prestressing action and the rolling pressure which comes on the bearing chocks 8,9,10,11 of the work rolls 12,13 and on the bearing chocks 16,17,18,19 of the backup rolls 14,15. The straining of the bearing chocks 16,17,18,19 of the backup rolls 14,15 is lessened and the reliability of these chocks, as well as that of the stand as a whole, is consequently enhanced.

The procedure of stand adjustment is as follows.

A new set of the work rolls 12,13 integrally with their bearing chocks 8,9,10,11 is assembled and adjusted outside the stand. For taking the used set of the work rolls 12,13 down, the fulcrum pin 26 must be withdrawn and the cap 25 must be connected to the eccentric shaft 31 (FIGS. 1,4) which is deprived of the ability to turn because of the threaded stop 40 contacting the flat "N" on the eccentric shaft 31 with its end face "M". The cap 25 is then pivoted integrally with the upper backup roll 15 by operating the power cylinder 33, and the work rolls 12,13 are withdrawn together with the bearing chocks 8,9, 10,11, using a crane, on driving out the fulcrum pins 55 and disconnecting the levers 56 from the shackles 54. For fitting the new set of the work rolls 12,13 into its place, lowering the cap 25 and assembling the pivotal joints, the above operations must be repeated in the reverse order.

On fitting the new set of the work rolls 12,13 into the stand, the axes of the roll grooves must be aligned with the axes of rolling in the vertical planes. The alignment is accomplished with the aid of the wedges 23 (FIG. 3) which, while being displaced due to the action of the screws 24, move the bearing chocks 16,17 of the lower backup roll 14 vertically through the intermediary of the spherical toes 22 and the thrust bearings 21. In the horizontal plane, the alignment of the axes of the grooves in the work rolls 12,13 with the axes of rolling takes place on its own accord when these rolls are being fitted into the stand by means of the rectangular grooves in the bearing chocks 8,10 which accommodate the vertical guides 6 of the carriers 2,3 of the housing 1 (FIG. 2). The axes of the grooves in the lower work rolls 13 and in the upper work rolls 12 become aligned in the horizontal plane when the rolls are being fitted to their respective bearing chocks. The rolls are checked for alignment in a special fixture before being fitted into the stand.

The vertical adjustment of the rolls is followed by the operation of prestressing the stand and the work rolls 12,13 relatively to each other. Preparatory to that, the threaded stop 40 must be disengaged from the eccentric shaft 31 (FIG. 1).

The stand is prestressed with the aid of the means 30 of prestressing. The force the power cylinder 33 exerts on the eccentric shaft 31 through the lever 32 causes the eccentric shaft 31 to turn in the openings of the carriers 2,4 so that the cap 25 pivots about the fulcrum pin 26 due to the throw "e" which is selected so as to ensure the requisite amount of prestressing of the stand with due regard for the resilience of its components. The prestressing load thus set up is applied to the work rolls 12,13 by way of the pressure transducers 39 (FIG. 3), the bearing chocks 18,19 and the upper backup roll 15 and the hence transmitted to the housing 1 through the lower backup roll 14, the bearing chocks 16,17, the spherical toes 21, the thrust bearings 22, and the wedges 23. The pressure transducers 39 constantly monitor the magnitude of the prestressing load.

The prestressing of the work rolls 12,13 proper is accomplished by the power cylinders 52. The force they exert on the eccentric shafts 50 through the levers 56 causes the eccentric shafts 50 (FIG. 4) to turn in the borings of the bearing chocks 8,9 so that these chocks pivot about the fulcrum pins 46 due to the throw "f" which is selected with due regard for the resilience of the leverages 51 so that the work rolls 12,13 contact each other with a requisite pressure.

The pressure transducers 47 constantly monitor the magnitude of the load applied to the work rolls 12,13 by the additional means of a prestressing. The total amount of prestressing of the work rolls 12,13 that can be applied with the aid of the means 30 of prestressing and the additional means of prestressing is set taking into account the maximum radial rolling pressure and the permissible limit of tolerans used during the rolling of tubes. The load on the bearing chocks 8,9,10,11 of the work rolls 12,13 and on the bearing chocks 16,17,18,19 of the backup rolls 14,15 is specified with due regard for the load-bearing capacity of the chocks.

Example. If the radial rolling pressure is 60 t/strand, the load bearing capacity of each of the bearing chocks 8,9,10,11 of the work rolls 12,13 is 30 t and that of each of the bearing chocks 16,17,18,19 of the backup rolls is 90 t, it is practical to prestress the bearing chocks of the work rolls 12,13 and those of the backup rolls 14,15 with a load of 15 t and 45 t, respectively.

The disclosed pilger mill stand with an additional means of prestressing the work rolls is characterized by a reduced loading of the bearing chocks of the backup rolls. This design feature extends the service life and enhances the reliability of the bearing chocks of the backup rolls and of the stand as a whole.

INDUSTRIAL APPLICABILITY

The present invention can be used to advantage on pilger mills which roll tubes from various materials; those which reluctantly yield to deformation included, at increased rates of squeezing.

What is claimed is:

1. A pilger mill stand comprising a housing; carriers located pairwise on either side of an axis of rolling and oppositely to each other; vertical guides positioned in said housing; bearing chocks fitted onto said vertical guides; upper and lower work rolls supported in respective bearing chocks and disposed one above the other; upper and lower backup rolls supported in respective bearing chocks and said work rolls being disposed between said upper and lower back rolls; a cap positioned on aid housing and pivotally linked to said carriers; means for prestressing said stand pivotally linked to said carriers; and means of prestressing said work rolls separately interconnecting a first bearing chock of said upper work roll to a first bearing chock of said lower work roll and a second bearing chock of said upper work roll to a second bearing chock of said lower work roll.

2. A pilger mill stand as claimed in claim 1, wherein said means for prestressing said work rolls comprises two leverages with eccentric elements, said leverages including first and second vertical tie rods pivotally linking opposite sides of said bearing chocks of said work rolls, one pair of bearing chocks for said upper or said lower work roll being connected to first ends of each of said vertical tie rods by fulcrum pins, and the other pair of bearing chocks for either said upper or lower work roll having one bearing chock connected to a second end of a first tie rod with a pressure transducer and a second bearing chock connected to a second end of a second tie rod by an eccentric shaft driven by a drive.

* * * * *